United States Patent [19]

Bakker et al.

[11] 3,936,691

[45] Feb. 3, 1976

[54] COLOR CATHODE RAY TUBE FRAME-COLOR SELECTION ELECTRODE SUPPORT STRUCTURE

[75] Inventors: Gijsbertus Bakker; Johannes Aloysius van Leeuwen, both of Eindhoven, Netherlands

[73] Assignee: U.S. Philips Corporation, New York, N.Y.

[22] Filed: Nov. 1, 1974

[21] Appl. No.: 520,008

[30] Foreign Application Priority Data

Nov. 21, 1973 Netherlands ..... 7315905

[52] U.S. Cl. ..... 313/407; 313/404

[51] Int. Cl.[2] ..... H01J 29/06; H01J 31/20

[58] Field of Search ..... 313/407, 404

[56] References Cited

UNITED STATES PATENTS 3,387,159 6/1968 Schwartz et al. ..... 313/404

3,808,493 4/1974 Kawamura et al. ..... 313/404

FOREIGN PATENTS OR APPLICATIONS 7,205,544 10/1972 Netherlands ..... 313/404

*Primary Examiner*—Robert Segal

*Attorney, Agent, or Firm*—Frank R. Trifari; George B. Berka

[57] ABSTRACT

A cathode ray tube of the shadow mask type for displaying coloured pictures. Colour defects are reduced to a considerable extent by minimizing the influencing as a result of temperature influences of the shape of the shadow mask by the frame in which said shadow mask is mounted by means of supporting means which are resilient in the radial direction.

6 Claims, 9 Drawing Figures

COLOR CATHODE RAY TUBE FRAME-COLOR SELECTION ELECTRODE SUPPORT STRUCTURE

The invention relates to a cathode ray tube for displaying colored pictures and comprising in an evacuated envelope means for generating at least two electron beams, a display screen on a part of the wall of said envelope, and a mainly rectangular color selection electrode which is secured in the cathode ray tube near the display screen while using a supporting frame in which the color selection electrode is secured by means of resilient supporting means present at the edge thereof.

Such a cathode ray tube, sometimes termed shadow mask tube, is known from the published Dutch Patent application No. 7,205,544 in which the color selection electrode, hereinafter sometimes referred to as mask, is secured to the supporting frame by means of resilient supporting means. The mask of such a tube has a large number of apertures through which generally three electron beams pass which are converged on the display screen and which enclose a small angle with each other, the so-called color selection angle. The display screen is covered with triplets of red, green and blue luminescing regions. Each of the three electron beams impinges upon luminescent regions of one color if the position of the mask and hence of the holes therein is accurately determined relative to said regions.

Since approximately 85 percent of the electrons are intercepted by the mask, mask and frame will be heated, particularly when the cathode ray tube is put in operation, and start expanding. The said expansion of the mask and the frame will usually not be the same. When the mask is rigidly secured to the frame (for example, by welding) said inequality in expansion causes a mutual influencing resulting in a bulging or stretching of the mask. Said deformation of the mask and the larger spacing between the apertures in the mask as a result of the thermal expansion will cause shifts of said apertures relative to the luminescent regions and hence color defects.

In the above-mentioned patent application the mutual influencing is reduced by securing the mask to the frame by means of lug-shaped resilient supporting elements or by strip-shaped resilient supporting elements obtained by incision of the mask. However, the drawback of said method of securing still is that a movement of the mask relative to the frame in the tangential direction (along the circumference of the frame) is not possible so that deformation of the mask will still occur.

It is the object of the invention to avoid the mutual influencing of mask and frame as a result of differences in expansion and hence to reduce considerably the occurrence of color defects in such a cathode ray tube.

According to the invention, a cathode ray tube of the kind mentioned in the first paragraph is characterized in that the supporting means permit of a movement of any point of the edge of the color selection electrode substantially along a line through the centre of the color selection electrode.

The invention is based on the recognition that both the mask and the frame expand uniformly. From the centre of the mask and the frame the expansion will extend along radians. When supporting means are provided which permit of a movement in the radial direction, the mutual influencing is minimum.

In a cathode ray tube according to the invention every supporting means to secure the mask in the frame preferably consists of a strip-shaped resilient element the direction of bending of which coincides with the direction of the said line through the centre of the color selection electrode.

Such a strip-shaped resilient element is obtained inter alia from lugs which are obtained by incision of the mask and which are twisted in such manner that their direction of bending coincides mainly with the direction of the said line through the centre of the color selection electrode.

The coincidence of the direction of bending of the strip-shaped resilient elements with the direction of the said line is also obtained by securing same to lugs obtained by incision of the supporting frame, said lugs being twisted in such manner that the free end thereof extends substantially perpendicularly to the said line.

A cylindrical pin may also be used instead of a strip-shaped resilient element. The advantage hereof is that such a pin has no preferred direction.

The strip-shaped resilient elements may also be secured to a part of the circumference of the supporting frame and the edge of the color selection electrode, which part is present between a corner and the centre of a side and which is substantially perpendicular to a line through the centre of the color selection electrode.

In a particular embodiment of a cathode ray tube according to the invention the supporting means enclose an acute angle with a line perpendicular to the color selection electrode and proceeding to the centre thereof, so that upon expansion of the color selection electrode and the supporting frame relative to each other a change of the distance of the color selection electrode relative to the display screen is obtained. Such an embodiment may be used inter alia to compensate for a displacement as a result of a small extent of stretching or bulging of the mask in the supporting frame. Said bulging and stretching may occur when the supporting means have a non-negligible rigidity. The bulging results in a small average displacement of the mask towards the dislay screen, stretching results in a displacement away from the display screen.

The invention will now be described in greater detail with reference to the accompanying drawing, of which:

Figure 1:
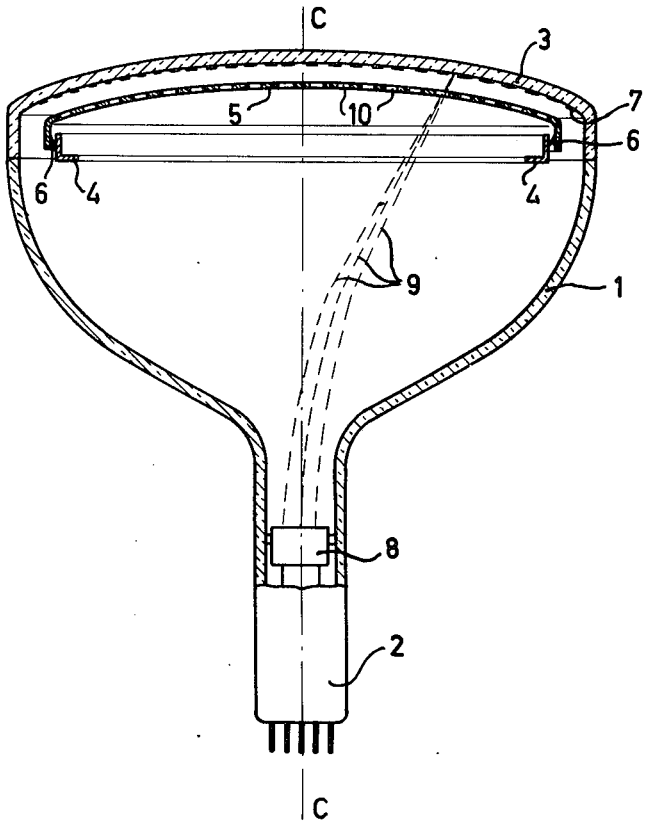
FIG. 1 shows a cathode ray tube according to the invention.

FIG. 1 shows a cathode ray tube for displaying color pictures according to the invention and comprising a glass envelope 1, a neck 2 and a spherical and outwardly bulged, preferably substantially rectangular, display window 3. Present in the envelope is a supporting frame 4 having therein a color selection electrode (mask) 5 which is secured by means of supporting means 6, a display screen 7 which consists of triplets of red, green and blue luminescing phosphor regions and an electron gun 8 which generates three electron beams 9 which impinge upon the display screen 7 after having passed through the apertures 10 in the mask 5. C—C denotes the axis of the cathode ray tube.

Figure 2:
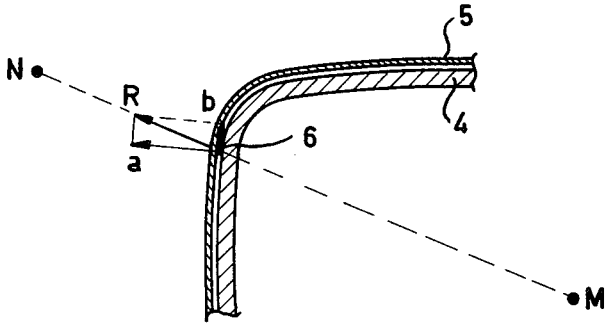
FIG. 2 shows diagrammatically the occurring forces.

Reference numeral 5 in FIG. 2 denotes a part of the mask and reference numeral 4 a part of the supporting frame to which the mask is secured by means of a supporting element 6. R is a vector which, in the case of a difference in expansion of the mask 5 and the supporting frame 4, represents the force occurring from their centre M and which is constructed from a component *a* extending perpendicularly to the edge of the mask and a tangential component *b*. The supporting means must be placed so that a movement is possible of points present on the mask and the supporting frame at the area of the connection of the supporting means along the line M–N.

Figure 3:
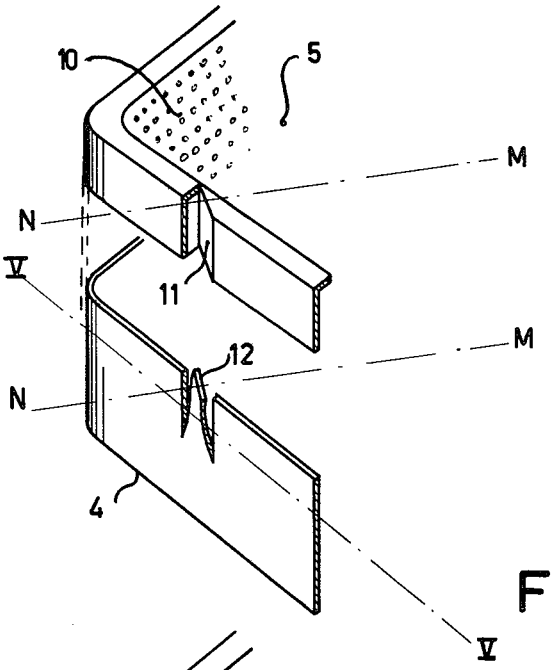
FIGS. 3, 4, 5, 6 and 7 show several embodiments.

FIG. 3 shows the supporting frame 4 and the mask 5 separately. Actually, the strip-shaped resilient element 11 is welded to the twisted lug 12 which is obtained by incision of the supporting frame 4. The strip-shaped resilient element 11 may be welded to the mask 5 or be obtained by incision of the mask.

Figure 4:
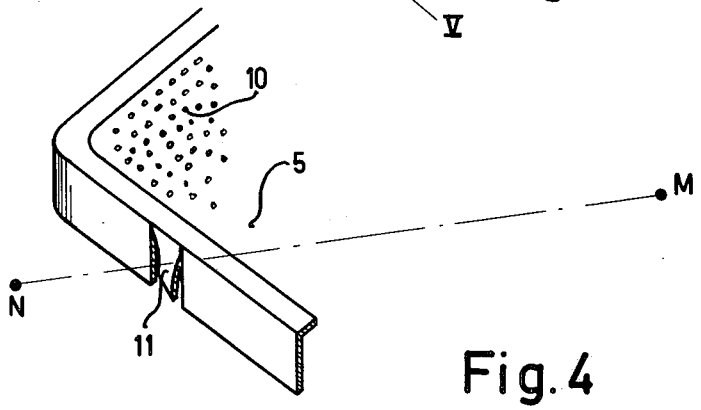

FIG. 4 shows a mask in which a strip-shaped resilient element 11 has been obtained by incision of the mask 5 and by twisting the resulting strip in such manner that the direction of bending thereof coincides mainly with the direction of the line M–N through the centre M of the mask.

Figure 5:
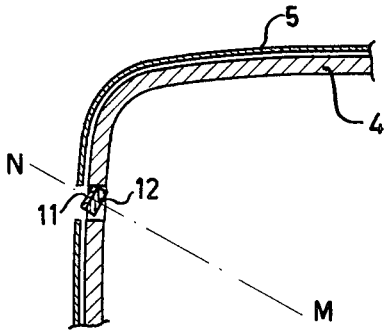

FIG. 5 is a sectional view taken on the line V-V of FIG. 3.

Figure 6:
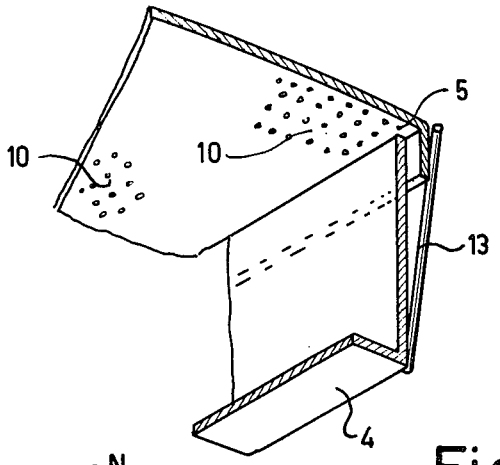

FIG. 6 is a perspective sectional view of a connection of the mask 5 to the supporting frame 6 by means of cylindrical pins 13. Due to the flexibility of the pins, bending in the direction of the centre of the supporting frame is possible in this case also.

A particular embodiment of the invention is the use of a mask manufactured from a material having a negligible coefficient of expansion (for example, material known as Invar and consisting of approximately 36% Ni and 64% Fe) and an iron supporting frame. In order to eliminate the influence of the supporting frame in the case of expansion on the substantially non-expanding mask, movement of the supporting frame relative to the mask should be possible in the tangential direction also. This is realized by the invention. It is known that in cases in which the mask has been manufactured from a material having a non-negligible coefficient of expansion, the apertures in the mask move relative to the triplets of phosphor regions present on the screen. It is also known that this effect can be compensated for by means of a suspension of the supporting frame in the envelope by means of bimetallic springs which move the mask in the supporting frame towards the display screen. In this particular embodiment the said bimetallic springs may be dispensed with since the mask does substantially not expand.

Figure 7:
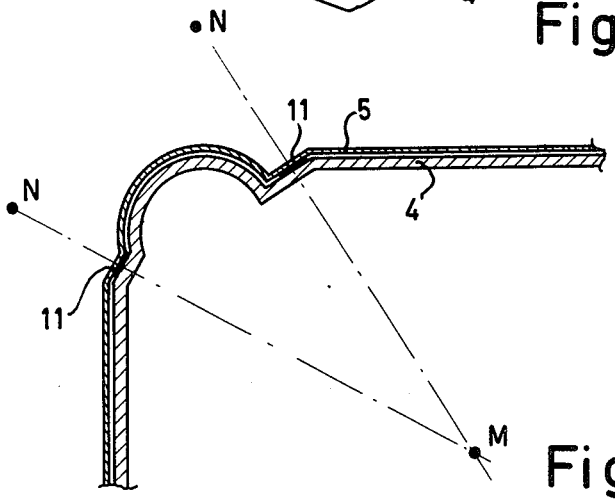

FIG. 7 is a sectional view analogous to FIG. 5 which also shows a part of the supporting frame 4 and the mask 5. Both the mask and the supporting frame at the area of the connection of the strip-shaped resilient elements have such a shape that the direction of bending of said resilient elements coincides with the direction of the line M–N.

Figure 8:
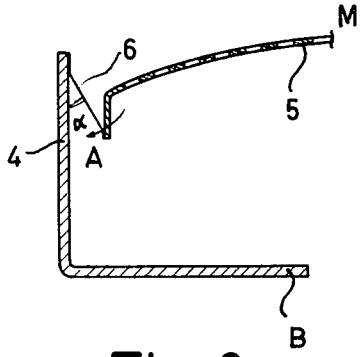
FIGS. 8 and 9 show diagrammatically a few possible movements of the mask.

FIG. 8 shows diagrammatically how, upon expansion, the mask moves relatively to the supporting frame as a result of placing the supporting means 6 at an acute angle. If the supporting frame 4 expands more rapidly than the mask 5, the latter moves away from part B of the supporting frame. If, however, the mask expands more rapidly, this will move towards part B of the supporting frame.

Figure 9:
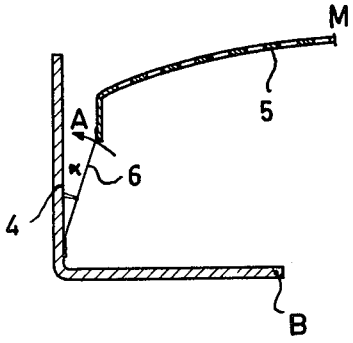

FIG. 9 also shows diagrammatically a movement analogous to that shown in FIG. 8. In this case the result is just reversed due to the supporting means 6 having been arranged in an opposite direction.

The movements shown in FIGS. 8 and 9 may be used to compensate for a small extent of stretching or bulging of the mask as a result of a non-negligible rigidity of the supporting means. A particular embodiment is, for example, a mask having a negligible coefficient of expansion and an iron supporting frame. When said supporting frame expands, the mask will be stretched taut more or less in the case of a non-negligible rigidity of the supporting means, so that on an average it will move away slightly from the display screen (in FIG. 8 towards B). This movement is compensated for by placing the supporting means 6 shown in FIG. 8 at a sufficiently large angle with the axis of the tube so that a substantially equally large displacement in the opposite direction takes place. A second particular embodiment is an iron mask in an iron frame. The mask will be heated more rapidly than the supporting frame because this can dissipate thermal energy to the atmosphere. The mask now expands to a greater extent than the supporting frame as a result of which the mask bulges (with a non-negligible rigidity of the supporting means). On an average the mask moves slightly towards the display screen. This movement is compensated for by a movement shown in FIG. 9. Since the mask itself will expand, bimetallic springs for the suspension of the supporting frame in the envelope will be necessary in this case to compensate in known manner for the displacement of the apertures in the mask.

What is claimed is:

1. A color cathode ray tube comprising an evacuated envelope and, within said envelope, means for generating at least two electron beams, a display screen on a part of the wall of said envelope, a substantially rectangular color selection electrode located near the display screen, a supporting frame spaced from and surrounding the edge of said color selection electrode, and a plurality of resilient supporting strip-shaped members connecting edge portions of said electrode to said frame, each supporting member being twisted near its center such as to be resilient both in radial and in tangential directions with respect to the center of said electrode.

2. A cathode ray tube as claimed in claim 1, wherein said strip-shaped resilient members are in the form of lugs which have been obtained by incision of the color selection electrode and which are twisted in such manner that the direction of bending of their free end coincides mainly with the radial direction.

3. A cathode ray tube as claimed in claim 1, wherein said strip-shaped resilient members are in the form of lugs which have been obtained by incision of the supporting frame and which have been twisted so that the direction of bending of their free end coincides with the radial direction.

4. A cathode ray tube as claimed in claim 1, wherein said resilient supporting members are located, respectively, between a corner and the center of each side of said electrode.

5. A color cathode ray tube comprising an evacuated envelope and, within said envelope, means for generating at least two electron beams, a display screen on a part of the wall of said envelope, a substantially rectangular color selection electrode located near the display screen, a supporting frame spaced from and surrounding the edge of said color selection electrode, and a plurality of resilient supporting pins connecting edge portions of said electrode to said frame, each supporting pin having a substantially circular cross-section to be resilient both in radial and in tangential directions with respect to the center of said electrode.

6. A cathode ray tube as claimed in 5, wherein said supporting pins enclose an acute angle with a line perpendicular to the color selection electrode and proceeding to the centre thereof, so that upon expansion of the color selection electrode and the supporting frame relative to each other a change of the distance of the colour selection electrode relative to the display screen is obtained.

* * * * *